US005520983A

United States Patent [19]

Yamamoto et al.

[11] Patent Number: 5,520,983

[45] Date of Patent: May 28, 1996

[54] OUTERLINING FABRIC FOR CURTAIN AND CURTAIN ATTACHMENT STRUCTURE USING THE SAME

[75] Inventors: Toru Yamamoto, Osaka; Mitsuhisa Okawa, Toyama, both of Japan

[73] Assignee: Yoshida Kogyo K.K., Tokyo, Japan

[21] Appl. No.: 272,315

[22] Filed: Jul. 8, 1994

[30] Foreign Application Priority Data

Aug. 5, 1993 [JP] Japan ..... 5-042999
Jun. 10, 1994 [JP] Japan ..... 6-128501

[51] Int. Cl.[6] ..... B32B 3/06

[52] U.S. Cl. ..... 428/100; 160/345; 160/DIG. 7; 428/99; 428/192; 428/193; 428/247; 428/257; 428/258

[58] Field of Search ..... 428/192, 193, 428/247, 257, 258, 99, 100; 160/123, 124, 330, 345, DIG. 7

[56] References Cited

U.S. PATENT DOCUMENTS

| | | | |
|---|---|---|---|
| 3,235,926 | 2/1966 | Mates . | |
| 5,109,912 | 5/1992 | Gary | 160/330 |
| 5,178,923 | 1/1993 | Andrieu et al. | 428/100 |
| 5,407,722 | 4/1995 | Peawe et al. | 428/100 |

FOREIGN PATENT DOCUMENTS

| | | |
|---|---|---|
| 42575 | 11/1973 | Australia . |
| 651585 | 11/1962 | Canada . |
| 0499461 | 8/1992 | European Pat. Off. . |

*Primary Examiner*—James J. Bell
*Attorney, Agent, or Firm*—Hill, Steadman & Simpson

[57] ABSTRACT

An outerlining fabric woven of warp threads and a weft thread and including at least two fastener portions composed of a male or a female member of a surface-type separable fastener, and a mesh portion of a predetermined width disposed between the fastener portions to separate them in the widthwise direction of the outerlining fabric, the weft thread being composed of a synthetic resin monofilament having a rigidity greater than that of any of the warp threads. The outerlining fabric is attached to and along the top edge of a curtain, and when the curtain is to be attached to a curtain rail, a series of curtain attachment connector members each having a fastener surface are attached to either of the fastener portions of the outerlining fabric. With the outerlining fabric, the vertical position of the curtain relative to the curtain rail can be changed among at least two positions. Due to the rigidity of the monofilament in the outerlining fabric, the top edge of the curtain is always held in an upstanding position even when the curtain attachment connector is attached to the lower fastener portion.

27 Claims, 10 Drawing Sheets

OUTERLINING FABRIC FOR CURTAIN AND CURTAIN ATTACHMENT STRUCTURE USING THE SAME

BACKGROUND OF THE INVENTION

1. Field of the Invention

The present invention relates generally to various curtains for domestic and commercial uses including blackout curtains for theaters and hospitals, and more particularly to a outerlining fabric attached to the top edge of a curtain for enabling attachment of the curtain relative to a curtain rail selectively at a first position in which the curtain rail is exposed from the curtain, or at a second position in which the curtain rail is concealed with the curtain, and also to a curtain attachment structure using the outerlining fabric.

2. Description of the Prior Art

In general, a curtain includes a outerlining fabric made of a tough woven cloth and attached to a top edge of the curtain to reinforce a suspended portion of the curtain which is subjected to a maximum external force and also to straighten the form of the suspended portion. The outerlining fabric has a plurality of hook-attachment portions formed at predetermined intervals along the length of the outerlining fabric. To attach the curtain to a curtain rail, a plurality of metal hooks are first attached to the corresponding hook-attachment portions of the outerlining fabric and then hooked one by one on the hooks or rings of curtain runners which have been slidably mounted on the curtain rail.

In attaching a curtain to a curtain rail, a need may arise that the vertical relative position between the curtain and the curtain rail be changed. For example, when the curtain rail used is highly decorative, the decorative curtain rail will preferably be exposed from the upper edge of the curtain. In this case, the hooks are attached to the top edge of the curtain. On the other hand, when the curtain rail needs to be concealed with the top edge of the curtain, hooks must be attached to a portion of the curtain located somewhat below the top edge of the curtain.

However, since the hook-attachment portions of the curtain are generally arranged in a single horizontal row, to meet the desire to change the vertical position of the curtain relative to the curtain rail, a set of hooks of an appropriate length is selected out among a plurality of previously prepared sets of hooks of different lengths.

In recent years, the demand for curtains has greatly increased, and replacement and laundering of the curtains have become frequent. To improve the efficiency of a curtain replacement work, various attempts have been proposed to facilitate attachment/detachment of the curtain relative to curtain runners mounted on the curtain rail. For example, according to curtain attachment connectors disclosed in Japanese Patent Publication No. 40-27706 and Japanese Utility Model Laid-open Publication No. 57-142986, a plurality of curtain runners are attached to one of a pair of male and female surface-type separable fastener tapes at predetermined intervals along the whole length of the separable fastener tape, and the other separable fastener tape is attached to a top edge of the curtain along the length thereof for engagement with the one separable fastener tape. Another curtain attachment connector disclosed in Japanese Utility Model Laid-open Publication No. 2-107387 includes a plurality of male or female surface-type separable fastener strips each attached by bonding to the curtain-attachment portion of one of a plurality of curtain runners, and a mating surface-type separable fastener tape attached to and along the top edge of a curtain.

By using the curtain attachment connectors, the curtain can readily be attached to the curtain runners by lightly pressing the male and female surface-type separable fastener members into face-to-face relation. Detachment of the curtain from the curtain runners can readily be effected by progressively peeling the two separable fastener members apart.

However, since the surface-type separable fastener members which are used in the curtain attachment connectors disclosed in the above-mentioned Japanese publications are of the general type, they cannot change the vertical attachment position of the curtain relative to the curtain rail. If such a positional change is an indispensable requirement, the position of attachment of the surface-type separable fastener member should be changed for every curtain to be attached.

It may be true that the foregoing requirement can be met by enlarging the width (i.e. vertical distance) of a surface-type separable fastener member attached to the top edge of a curtain. However, the use of a wide surface-type separable fastener member exerts a great influence on the production cost and hence cannot be acceptable in the commercial aspect. In addition, since the wide surface-type separable fastener member has no additional consideration on the formation of pleats beyond the conventional technique, the top edge of the curtain becomes rigid due to the wide surface-type separable fastener member attached thereto. As a result, during the operation of the curtain, and more particularly when the curtain is fully opened, it is hardly possible to place the curtain in a neatly folded condition. Even when a curtain belt is used to bind the curtain, the curtain is likely to be folded unsightly and hence defective from the aesthetic view.

SUMMARY OF THE INVENTION

In view of the foregoing drawbacks of the prior art, it is an object of the present invention to provide an outerlining fabric which can be produced easily and efficiently, can readily be attached to a curtain with high accuracy, and enables the curtain to change its position of attachment relative to a curtain rail among at least two different vertical positions.

Another object of the present invention is to provide a curtain attachment structure using the outerlining fabric.

A further object of the present invention is to provide a curtain attachment structure which is capable of automatically forming pleats on a curtain, without the necessity of a particular processing operation effected on the curtain, when the curtain is attached to the curtain rail.

An elongated outerlining fabric of the present invention, which is adapted to be attached to and along the top edge of a curtain, includes at least two fastener portions having a woven structure and extending lengthwise of the elongated outerlining fabric, and a mesh portion having a net-like woven structure of a predetermined width and disposed between the fastener portions to separate them in the widthwise direction (i.e. vertical direction) of the outerlining fabric. Each of the fastener portions is composed of one of a pair of male and female surface-type separable fastener members. The outerlining fabric includes a weft thread running widthwise of the outerlining fabric and composed of a synthetic resin monofilament having a rigidity.

In another aspect the present invention provides an elongated outerlining fabric for curtains which includes at least one fastener portion having a woven structure of a predetermined width and extending lengthwise of the elongated outerlining fabric, and at least two mesh portions having a net-like woven structure and disposed on opposite sides of the fastener portion. The fastener portion is composed of one of a pair of male and female surface-type separable fastener members and is displaced from a longitudinal center line of the outerlining fabric to some extent toward one longitudinal edge of the outerlining fabric. The outerlining fabric includes a weft thread running widthwise of the outerlining fabric and composed of a synthetic resin monofilament having a rigidity. And in a further aspect of the present invention, an outerlining fabric, in which one of two halves of the outerlining fabric substantially from a longitudinal center line to one longitudinal edge of the outerlining fabric is formed to be a mesh portion, the fastener portion is disposed in the other half of the outerlining fabric, and the weft thread is composed of a synthetic resin monofilament having a rigidity. And preferably, the fastener portion is formed by a plurality of longitudinal ridges and at least a narrow linear non-ridged portion, and the ridges are composed of male engaging members and the non-ridged portion is composed of a net-like mesh portion.

A curtain attachment structure provided in accordance with the present invention includes a curtain having the above-mentioned fabric attached to and along the top edge of the curtain, a curtain rail, and an attachment connector slidably movable along the curtain rail and engageable with the outerlining fabric to attach the curtain to the curtain rail, the curtain attachment connector including a plurality of connector members each having a fastener surface releasably engageable with each of the fastener portions of the outerlining fabric.

The curtain attachment connector members may be separate from one another or interconnected by a cord. In addition, each of the curtain attachment connector members may be formed integrally with, or separately from, a curtain runner.

Assuming that the curtain attachment connector members are separate from one another and formed separately from the corresponding curtain runners, the attachment of a curtain to a curtain rail will be accomplished in a manner as follows.

A desired number of curtain runners are slidably mounted on the curtain runner. The outerlining fabric is attached by sewing, for example, to the curtain along the top edge thereof. In this instance, since a borderline between the mesh portion and each of the fastener portions forms a straight line, such a straight borderline can be used as a reference line during sewing operation.

Then, curtain attachment connector members which are equal in number to the number of the curtain runners are attached to one of the fastener portions of the outerlining fabric in an equally spaced relation along the length of the outerlining fabric. In this instance, if the curtain rail is to be concealed by the top edge of the curtain, the curtain attachment connector members are attached to a lower one of the fastener portions or are attached to the fastener portion while the fastener portion, which is formed to be displaced from the center line of the outerlining fabric, occupies lower part of the outerlining fabric. Alternatively, when the curtain rail is to be exposed from the top edge of the curtain, the upper fastener portion is selected for engagement with the curtain attachment connector members or the curtain attachment connector members are attached to the fastener portion while the fastener portion occupies upper part of the outerlining fabric.

Then, the curtain attachment connector members are attached to the corresponding runners to thereby attach the curtain to the curtain rail. In this instance, if the curtain attachment connector members are attached to the upper fastener portion of the outerlining fabric, the curtain rail is exposed from the top edge of the curtain. Conversely, if the curtain attachment connector members are attached to the lower fastener portion, the curtain rail is concealed by the top edge of the curtain. In the latter case, since the portion which supports the curtain is the lower fastener portion, the upper edge of the curtain stands upwardly of the supporting portion. However, the top edge of the curtain is able to hold its upstanding posture due to the rigidity of the synthetic resin monofilament running in the widthwise direction of the outerlining fabric (namely, in the vertical direction of the curtain).

As one or more non-ridged mesh portions are formed in the engaging portion of the outerlining fabric of the invention as described above, sewing operation is facilitated when the outerlining fabric is sewn onto the curtain. Particularly, when the outerlining fabric of the invention is sewn onto a lace curtain, the mesh portion is transparent so that the appearance of the curtain will not be unsightly. Further, due to the mesh portion, the fastener portion can be dried up faster when the curtain is washed.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

Figure 12:
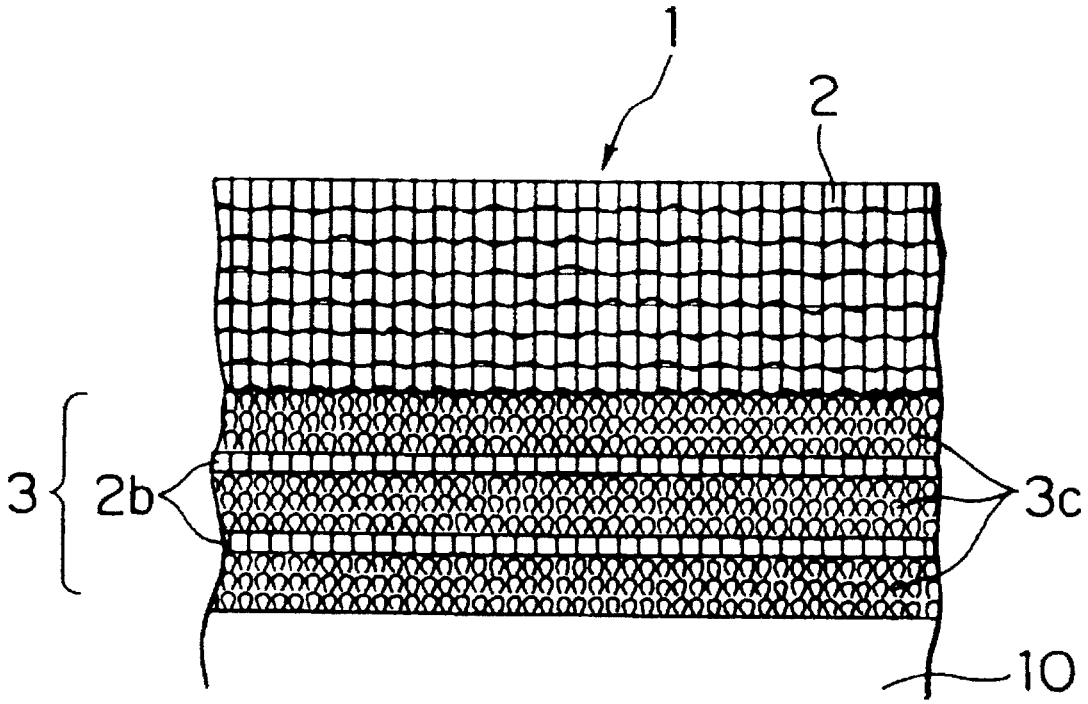
FIG. 12 is a partial plan view showing an outerlining fabric according to a further preferable embodiment of the present invention.

FIG, 13 is a side view of FIG. 12.

Figure 14:
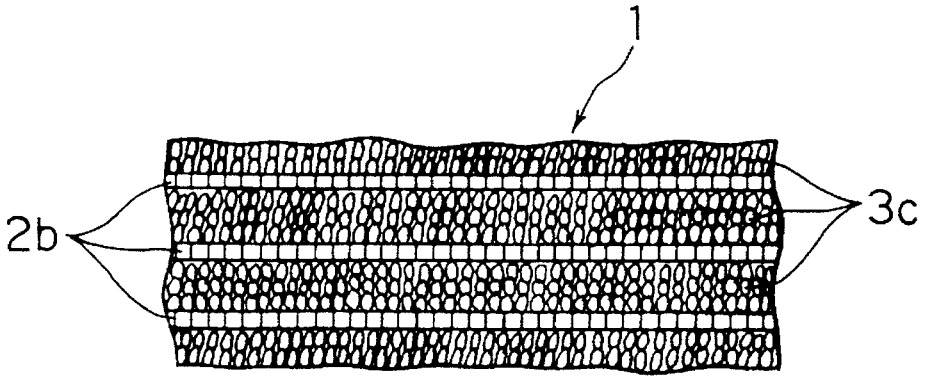

FIG. 14 is a partial plan view showing an outerlining fabric in which a fastener portion is composed of ridges and non-ridged portions according to the present invention.

DETAILED DESCRIPTION

Figure 1:
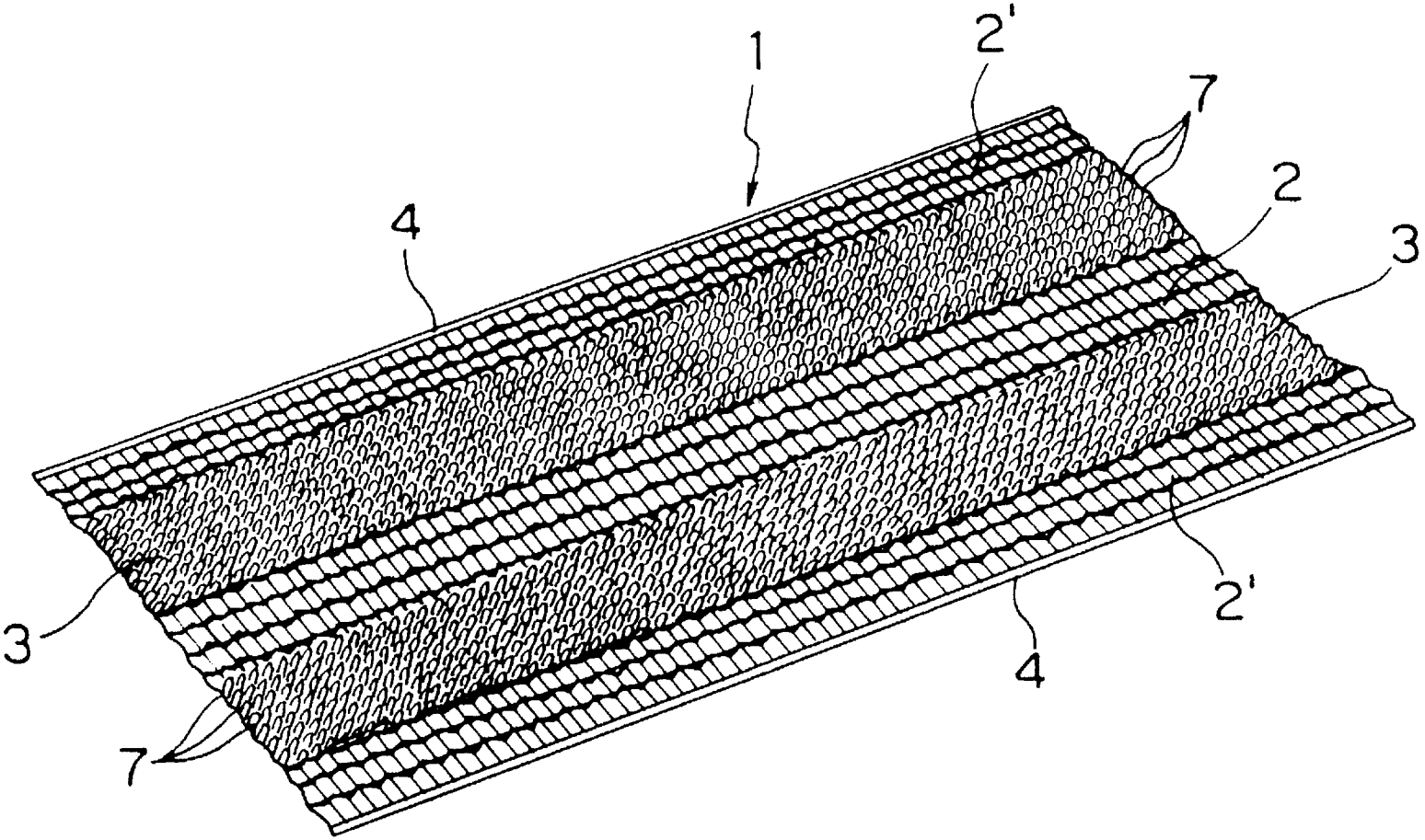
FIG. 1 is a perspective view showing the front side of an outerlining fabric according to an embodiment of the present invention.

Referring now to the drawings, wherein like reference characters designate like or corresponding parts throughout the several views, there is shown in FIG. 1 an outerlining fabric 1 according to an embodiment of the present invention. In use, the outerlining fabric 1 is attached to the top edge of a curtain for attaching the curtain to a curtain rail in a manner described later.

As shown in FIG. 1, the outerlining fabric 1 of this embodiment is composed of a woven tape-like fabric and includes at least two fastener portions 3, 3 extending lengthwise of the outerlining fabric 1 and spaced in the widthwise direction of the fabric 1 by a lace or net-like, central mesh portion 2 having a predetermined width. Two outer mesh portions 2, 2 are disposed on opposite sides of the central mesh portion 2, with each of the fastener portions 3 disposed between one of the outer mesh portions 2 and the central mesh portion 2. In the illustrated embodiment, each of the fastener portions 3 has a large number of closely spaced interengageable fastener elements in the form of loops 7 projecting from one surface of the outerlining fabric 1. The fastener portion 3 thereby forms a female or looped fastener member of a surface-type separable fastener generally known as "hook-and-loop" fastener. The fastener portions 3 may be composed of a male or hooked fastener member having a large number of closely spaced hooks projecting from one surface of the outerlining fabric 1.

Figure 2:
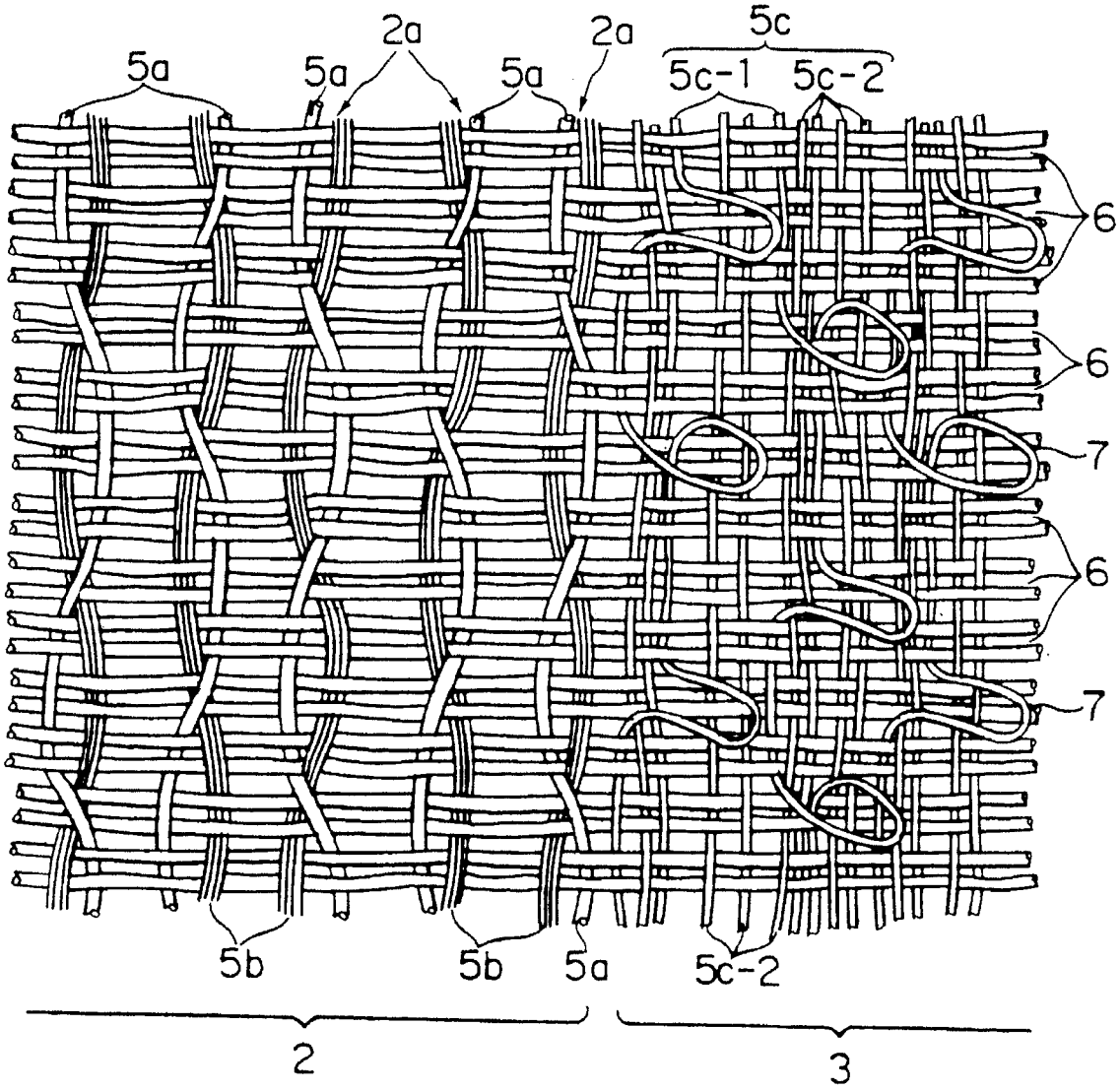
FIG. 2 is an enlarged pictorial plan view showing the woven structure of a central portion of the outerlining fabric.
Figure 3:
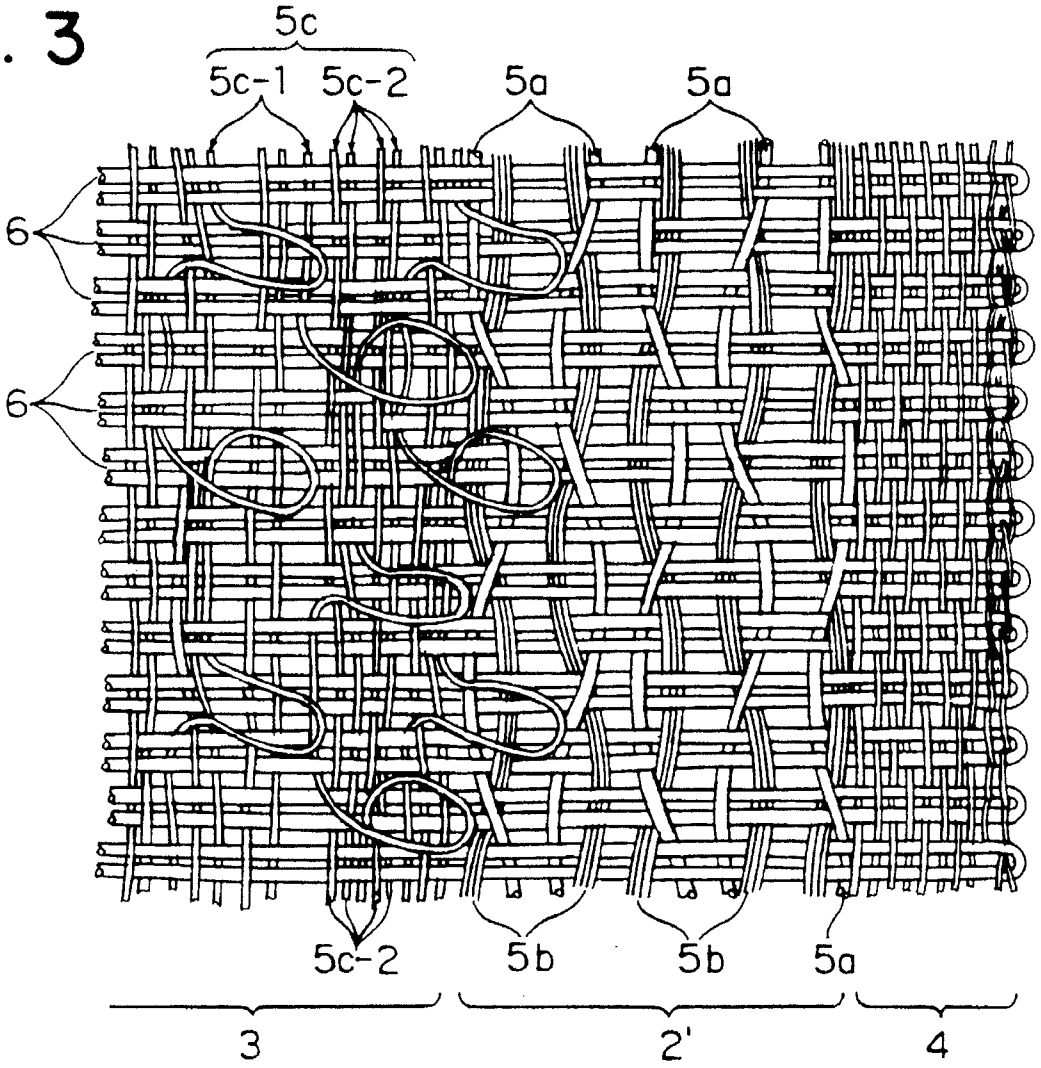
FIG. 3 is an enlarged pictorial plan view showing the woven structure of one longitudinal edge portion of the outerlining fabric.

As shown in FIGS. 2 and 3, the woven tape-like outerlining fabric 1 is composed of a plurality of types of warp threads 5*a*, 5*b*, 5*c* running lengthwise of the outerlining fabric 1, and a foundation weft thread 6 running widthwise of the outerlining fabric 1 and interlaced with the warp threads 5*a*–5*c*. In the illustrated embodiment, synthetic resins of different sizes are used. The first warp threads 5*a* are composed of synthetic resin monofilaments having a relatively large filament size. The second warp threads 5*c* are composed of first multifilaments having a smaller filament size than the monofilaments 5*a*. The third warp threads 5*b* are composed of second multifilaments having the same filament size as the first multifilaments 5*c*. Each of the second multifilaments 5*b* is composed of a multiplicity of first multifilaments 5*c*.

The second multifilaments 5*b* are arranged over the entire area of the mesh portion 2 to form a foundation structure of the mesh portions 2, (FIGS. 1 to 3). The monofilaments 5*a* are arranged in the mesh portions 2, 2 and form, jointly with the second multifilaments 5*b*, a gauze fabric structure. Thus, the monofilaments 5*a* constitute a part of the foundation structure in each of the mesh portions 2, 2. The first multifilaments 5*c* are arranged in the fastener portions 3. In each of the fastener portions 3, a part 5*c*-1 of the multifilaments 5*c* which is interlaced with the foundation weft thread 6 forms a number of uncut loops 7 projecting from one surface of the outerlining fabric 1, the rest 5*c*-2 of the multifilaments 5*c* which is interlaced with the foundation weft thread 6 forms a portion of the foundation structure.

The weft thread 6 is composed of a monofilament made of the same material as the monofilaments (first warp threads) 5*a*. The outerlining fabric 1 is woven on a needle loom and the weft thread 6 is inserted in double pick. The total filament size of the weft thread 6 (i.e., the filament size of a pair of parallel juxtaposed portions of the weft thread 6 formed in each pick or insertion of the weft thread 6) is larger than that of the monofilament 5*a*. The weft thread 6, which is composed of a monofilament and which has a total filament size larger than the filament size of any other thread 5*a*–5*c*, has a rigidity greater than that of any of the warp threads 5*a*–5*c*. The outerlining fabric 1 having such a rigid weft thread 6 possesses a sufficient rigidity in the widthwise direction (weftwise direction) of the outerlining fabric 1.

As is apparent from FIGS. 2 and 3, the foundation structure of the woven tape-like outerlining fabric 1 is dominantly composed of a plain weave structure. However, of the first multifilaments 5*c*, these parts 5*c*-1 which are used to form the loops 7 in the fastener portions 3 pass alternately under and over three consecutive picks of the weft thread 6, and after that each of the loop-forming first multifilaments 5*c*-1 moves into a different inter-warp space over and across the succeeding pick of the weft thread 6 and two adjacent ones of those multifilaments 5*c*-2 which form the foundation structure. During that time, each of the loop-forming first multifilaments 5*c*-1 forms a single loop 7 projecting from the foundation structure of the outerlining fabric 1. Subsequently, the loop-forming first multifilament 5*c*-1 passes alternately under and over the following three consecutive picks of the weft thread 6, and then returns into the original inter-warp space across the succeeding pick of the weft thread 6 and the foundation-forming first multifilaments 5*c*-2 during which time a similar loop is formed by the loop-forming first multifilament 5*c*-1. Thereafter, the foregoing procedure is repeated so that the fastener portions 3 are produced. In the illustrated embodiment, each of the fastener portions 3 has ten rows of loops 7 equally spaced in the widthwise direction of the outerlining fabric 1. Between each pair of adjacent loop rows, there are arranged two foundation-forming first multifilaments 5*c*-2 interlaced with the weft thread 6 to form a plain weave structure.

The thus formed fastener portions 3 are spaced by the central mesh portion 2 in widthwise direction of the outerlining fabric 1. As clearly shown in FIG. 2, the central mesh portion 2 has a woven structure of gauze fabric in which pairs of the monofilaments 5*a* and second multifilaments 5*b* cross one another and thereby keep the foundation weft thread 6 in position. More particularly, the central mesh portion 2 has five monofilaments 5*a* and five second multifilaments 5*b* making five pairs. Each of the monofilaments 5*a* and a corresponding one of the second multifilaments 5*b* are interlaced, in a pattern of plain weave, with three consecutive picks of the weft thread 6 and twisted around each other at every four picks of the weft thread 6.

Each of the outer mesh portions 2 which is disposed alongside of a corresponding one of the fastener portions 3 has a predetermined width and has substantially the same woven structure as the central mesh portion 2 with the exception that a selvage portion 4 is formed along the outer longitudinal edge of the outer mesh portion 2. As shown in FIG. 3, the woven structure of the outer mesh portion 2 comprises a gauze fabric in which five monofilaments 5*a* and five second multifilaments 5*b* cross one another to keep the foundation weft thread 6. Each of the monofilaments 5*a* and a corresponding one of second multifilaments 5*b* are interlaced, in the plain weave pattern, with three consecutive picks of the weft thread 6 and twisted around each other at every four picks of the weft thread 6. The selvage portions 4 have a woven structure which is well known per se and hence no further description thereof will be necessary. Loops of the foundations weft thread 6 are interlocked with chain stitches (FIG. 3) to form a selvage of the outerlining fabric 1.

Figure 4:
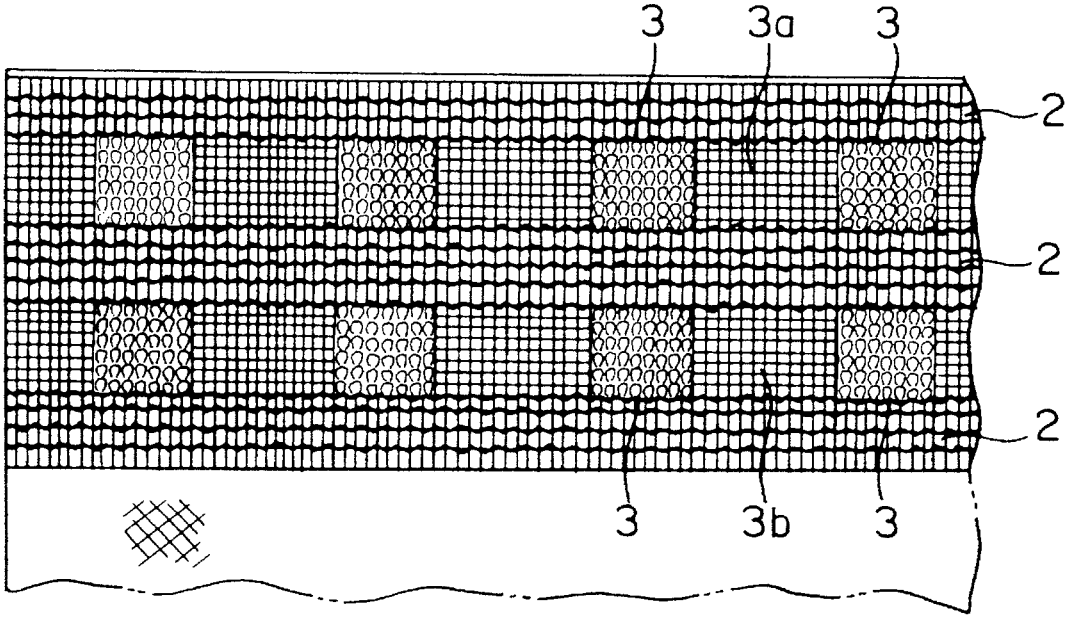
FIG. 4 is a diagrammatical plan view showing a modified arrangement of surface-type separable fastener portions of the outerlining fabric.
Figure 5:
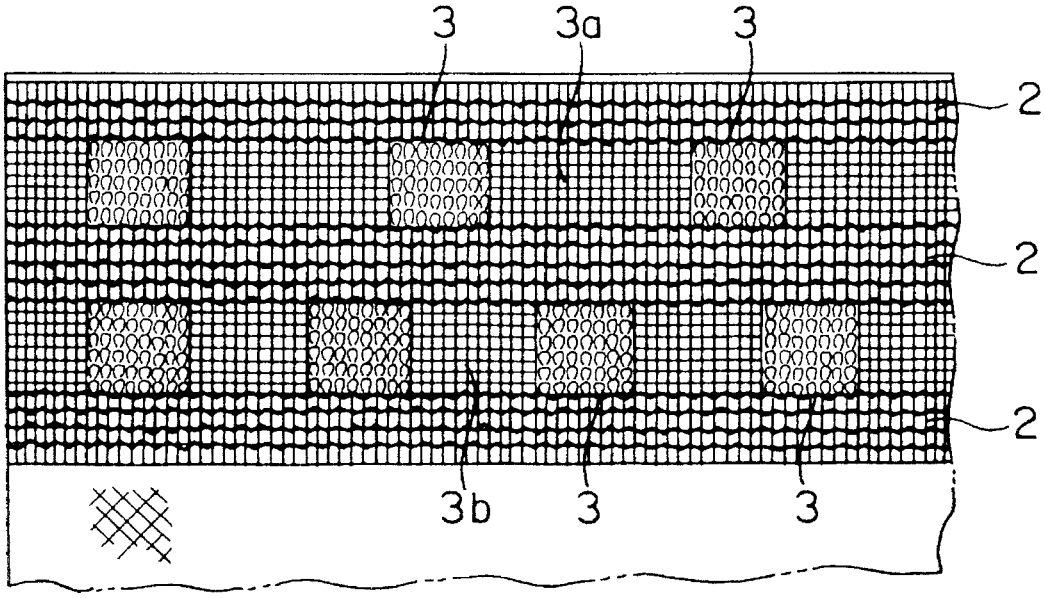
FIG. 5 is a view similar to FIG. 4, showing another modification of the arrangement of the surface-type separable fastener portions of the outerlining fabric.

In the embodiment, shown in FIG. 1, each of the fastener portions 3 is continuous and extends throughout the length of the tape-like outerlining fabric 1. The fastener portions 3 may be formed intermittently at predetermined intervals along the length of the outerlining fabric 1, such as shown in FIGS. 4 and 5. In the embodiment shown in FIG. 4, discrete rows of fastener portions 3 (indicated by hatching for clarity) are arranged lengthwise of the outerlining fabric 1 at prodetermined intervals, with a plurality of element-free spaces 3*a*, 3*b* disposed between adjacent ones of the fastener portions 3. Each of the fastener portions 3 in one row (upper row in FIG. 4) and a corresponding one of the fastener portions 3 in the other row (lower row in FIG. 4) are aligned with each other in the widthwise direction of the outerlining fabric 1. Each individual fastener portions 3 has a number of closely spaced loops (not shown but identical to those indicated by 7 shown in FIG. 1). The discrete fastener portions 3 can readily be formed by selecting an appropriate weaving pattern when the loop-forming second multifilaments 5*c*-1 are interlaced with the weft thread 6. The embodiment showing in FIG. 5 differs from the embodiment of FIG. 4 in that upper and lower rows of discrete fastener portions 3, 3 have different pitches. More particularly, the upper fastener portions 3 and the lower fastener portions 3 have the same extent in the lengthwise direction of the outerlining fabric 1, however, the element-free spaces 3*a* in the upper row of fastener portions 3 has a larger extent in the lengthwise direction of the outerlining fabric 1 than the element-free spaces 3*b* in the lower row of fastener portions 3.

Figure 6:
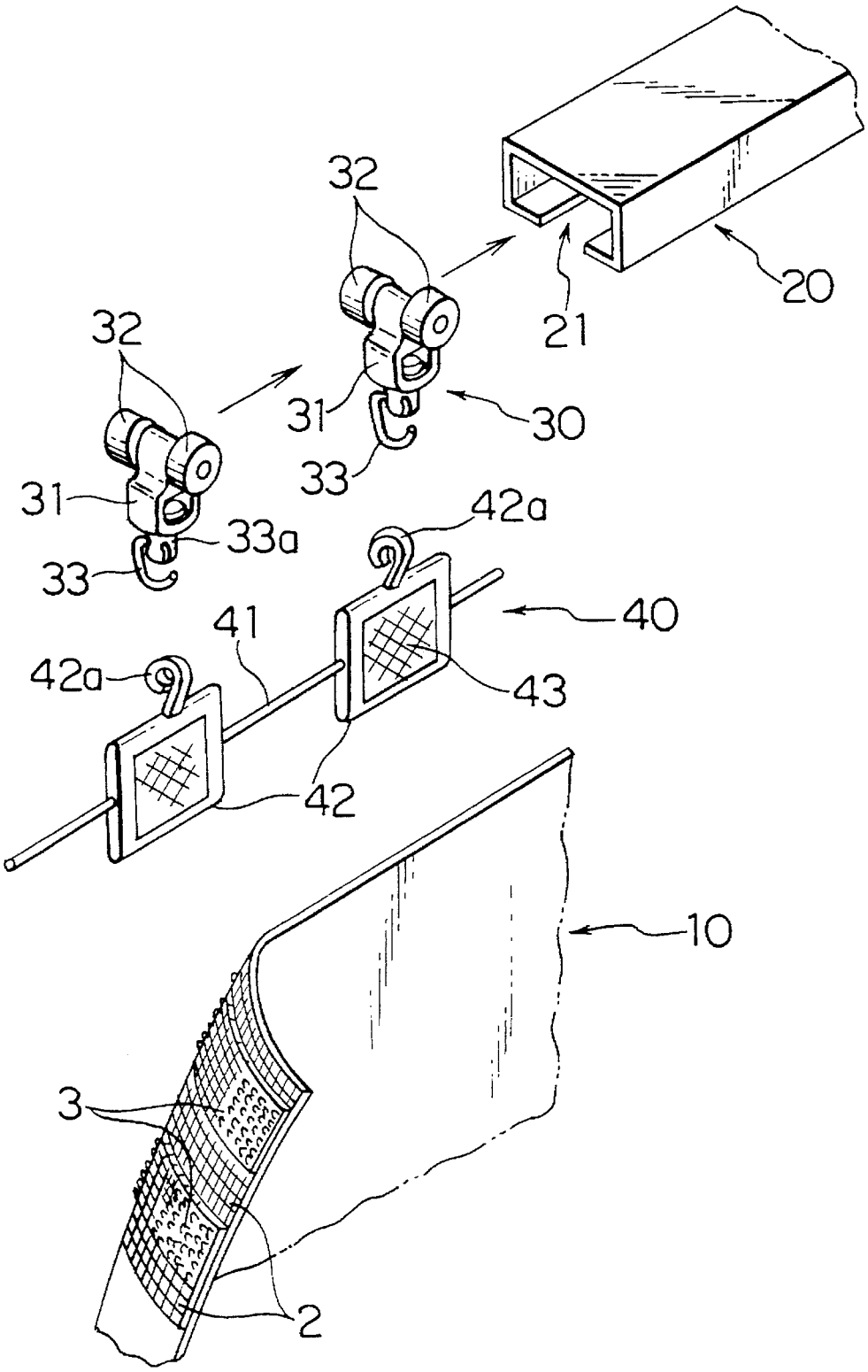
FIG. 6 is an exploded perspective view of a curtain attachment structure including the outerlining fabric attached to the top edge of a curtain.

In use, the outerlining fabric 1 of the foregoing construction is attached by sewing, for example, to a curtain 10 along the top edge thereof, as shown in FIG. 6. In this instance, since the mesh portions 2, 2 are clearly bordered by the fastener portions 3, 3, and since the fabric of the curtain 10 can be visually observed through the mesh portions 2, 2, sewing can be effected easily with high accuracy by using border-lines between the mesh portions 2 and the fastener portions 3 as reference lines. In FIG. 6, designated by numeral 20 is a curtain rail to which the curtain 10 is to be attached by a curtain attachment structure including the outerlining fabric 1. The curtain rail 20 is composed of an elongated C-section bar having a slit-like opening 21 extending in and along the bottom wall of the curtain rail 20.

The curtain attachment structure further includes a number of curtain runners 30 (only two being shown) slidably mounted in the curtain rail 20, and a curtain attachment connector 40 used to interconnect the outerlining fabric 1 and the curtain runners 30 to suspend the curtain 10 from the curtain runners 30. The curtain runners 30 and the curtain attachment connector 40 are formed separately from one another. The curtain attachment connector 40 may be formed integrally with the curtain runners 30 in a manner described later. Each of the curtain runners 30 includes a body 31, a pair of rollers 32 freely rotatably mounted on opposite sides of an upper portion of the body 31 and rollingly received in a hollow interior space in the curtain rail 20, and a swivel hook 33 attached to a lower end of the body 31 and freely rotatable about a vertical axis.

Figure 8:
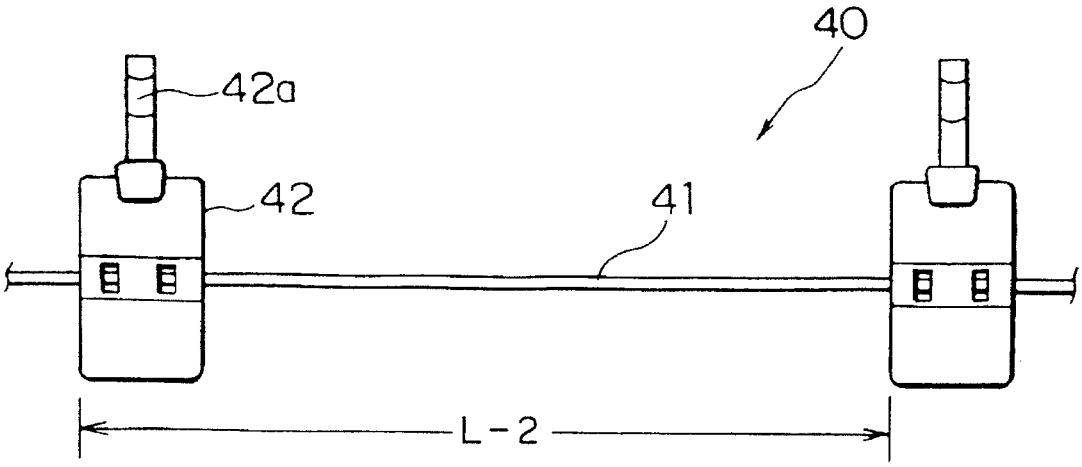
FIG. 8 is a partial rear elevational view of a curtain attachment connector.
Figure 9:
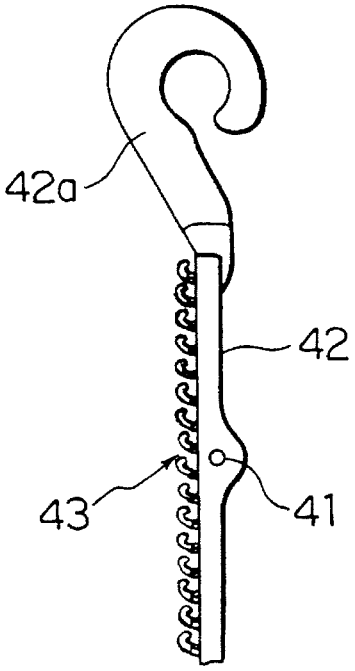
FIG. 9 is an enlarged side view of FIG. 8.

The curtain attachment connector 40 includes, as also shown in FIGS. 8 and 9, a single cord 41 and a number of rectangular plate-like curtain attachment connector members 42 (two being shown in FIGS. 6 and 8) that are integrally formed with the cord 41 at their central portions and equally spaced longitudinally along the cord 41. The cord 41 may be composed of a synthetic resin filament, a synthetic fiber yarn, a braided rope and the like and has desired strength and flexibility. The curtain attachment connector members 42 are attached to the cord 41 along the length thereof and spaced at regular intervals or pitches L-2 (FIG. 8). Each of the plate-like curtain attachment connector members 42 has a fastener surface 43 (FIGS. 6 and 9) composed of a male or hooked separable fastener member including a large number of closely spaced hooks (FIG. 9) formed integrally with the curtain attachment connector member 42. The curtain attachment connector member 42 has on its upper end a hook 42*a* adapted to be hooked on the swivel hook 33 of each of the curtain runners 30.

Figure 7:
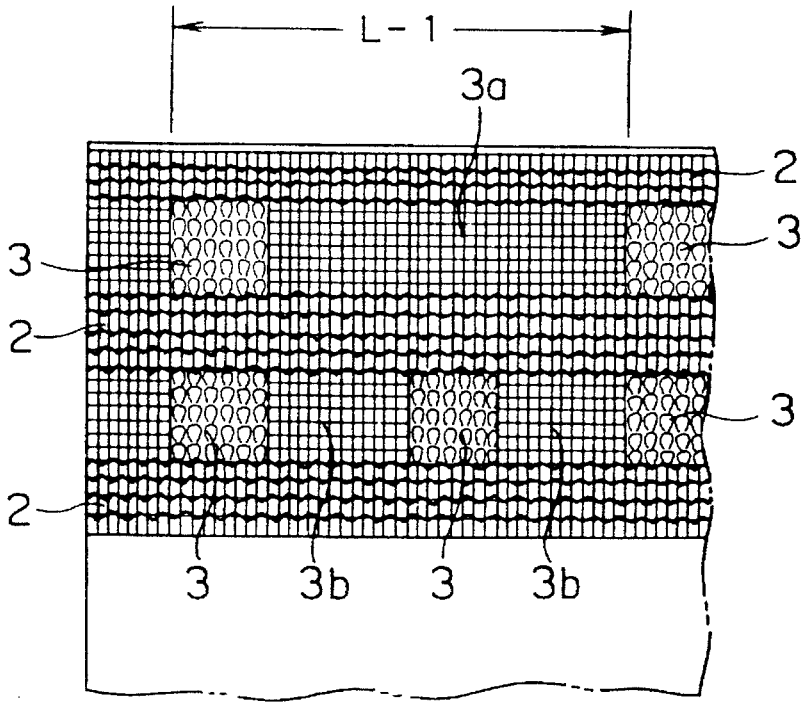
FIG. 7 is a diagrammatical plan view of the outerlining fabric as it is attached to the top edge of a curtain.

Now assuming that the outerlining fabric 1 used in this embodiment has a structure shown in FIG. 7, and the upper row of discrete fastener portions 3 have a pitch L-1 which is larger, by a predetermined distance, than the pitch L-2 (FIG. 8) of the curtain attachment connector members 42 mounted on the cord 41. With this arrangement, the curtain attachment connector members 42 of the curtain attachment connector 40 are attached one after another to the corresponding fastener portions 3 of the outerlining fabric 1 via the interlocking engagement between the hooked fastener surfaces 43 of the curtain attachment connector members 42 and the looped fastener members of the discrete fastener portions 3. In this instance, a portion of the curtain 10 which extends between each pair of adjacent fastener portions 3 of the outerlining fabric 1 is folded or warped by a distance equal to the pitch difference (L-1–L-2). The thus warped curtain portion automatically forms one pleat, so that when all the curtain attachment connector members 42 are attached to the fastener portions 3, a series of horizontally arranged pleats are formed on the curtain 10.

In the embodiment just described above, the curtain attachment connector members 42 are interconnected by the cord 41. However, the curtain attachment connector members 42 may be separated from one another. In addition, the hooks (FIG. 9) on the fastener surface 43 formed integrally with each individual curtain attachment connector member 42 may be replaced with a piece of male or hooked fastener tape (not shown) attached by bonding to one surface of the curtain attachment connector member 42.

When the curtain 10 having the outerlining fabric 1 previously attached thereto; is to be attached to the curtain rail 20 using the curtain attachment connector 40, a necessary number of curtain runners 30 are mounted on the curtain rail 10, as indicated by the arrows in FIG. 6, in such a manner that the swivel hooks 33 of the respective curtain runners 30 project downwardly from the slit-like opening 21 in the curtain rail 20. Then, the hooks 42*a* on the respective curtain attachment connector members 42 are hooked on the swivel hooks 33 of the corresponding curtain runners 30 to thereby suspend the curtain attachment connector 40 to the curtain runners 30. In this instance, one end of the cord 41 of the curtain attachment connector 40 is firmly connected to the corresponding end of the curtain rail 20 by a suitable clamping means (not shown), for example. Thereafter, the opposite end of the cord 41 is pulled to stretch the cord 41 along the curtain rail 20, so that all the curtain attachment connector members 42 are spaced and aligned in parallel relation to the curtain rail 20. Subsequently, either the upper fastener portions 3 of the outerlining fabric 1, or alternatively the lower fastener portions 3 of the outerlining fabric 1 which is attached to the top edge of the curtain 10 are successively forced, with a light pressure, against the fastener surfaces 43 of the individual curtain attachment connector members 42. Thus the curtain 10 is attached to the curtain rail 20 via the curtain attachment connector 40 and the curtain runners 30. When the curtain attachment work completes, a series of pleats are automatically formed on the curtain 10 along the top edge of the same.

Figure 10A:
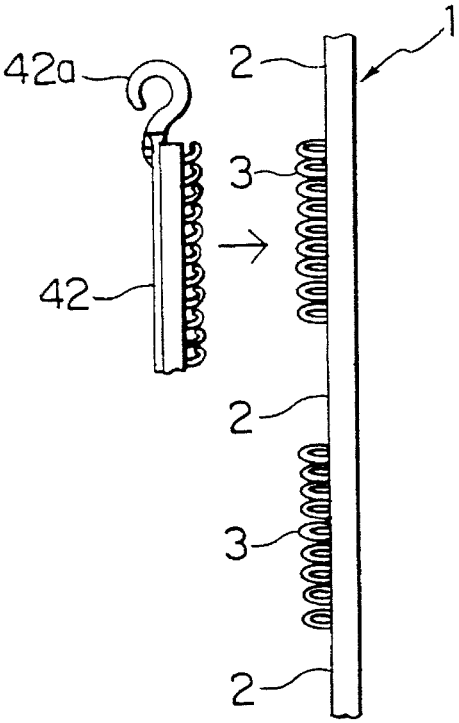
FIG. 10A is a schematic side view showing a first mode of attachment of the curtain.
Figure 10B:
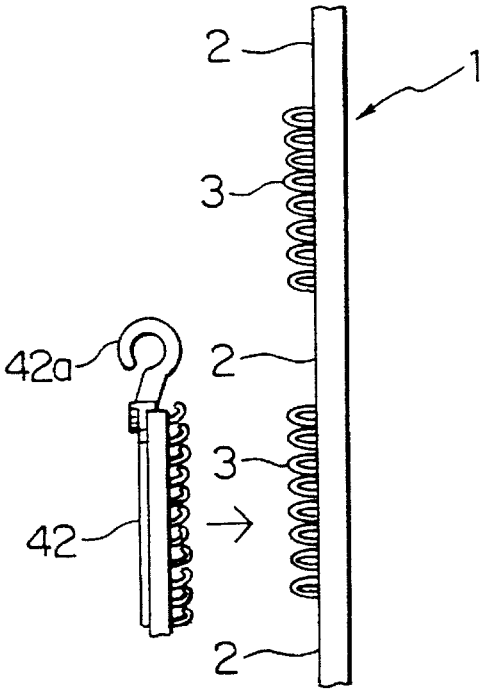
FIG. 10B is a schematic side view showing a second mode of attachment of the curtain in which the curtain has a different vertical attachment position from that in the first attachment mode.

In executing the foregoing curtain attachment work, if the curtain rail 20 is to be exposed above the top edge of the curtain 10, the curtain attachment connector members 42 are attached to the upper fastener portions 3 of the outerlining fabric 1 on the curtain 10, as shown in FIG. 10A. Alternatively, if the curtain rail 20 is to be concealed by the top edge of the curtain 10, the curtain attachment connector members 42 are attached to the lower fastener portions 3 of the outerlining fabric 1, as shown in FIG. 10B. In the latter case, a certain portion of the top edge of the curtain 10 projects upwardly from the curtain attachment connector members 42. However, since the outerlining fabric 1 is made rigid in its widthwise direction (namely, the vertical direction of the curtain 10) due to the rigidity of the monofilament 6 (weft thread), the top edge of the curtain 10 always holds its upstanding posture without collapsing toward the inside of a room or building.

As described above, since the attachment position of the outerlining fabric 1 relative to the curtain attachment connector members 42 can be selected between two, vertically spaced positions, the vertical curtain-attachment position can readily be changed over at user's desire. In addition, due to the mesh portion 2 disposed between two transversely spaced fastener portions 3, 3, the outerlining fabric 1 as a whole possesses an adequate flexibility. However, the flexibility in the widthwise direction (i.e. the vertical direction) of the outerlining fabric 1 is substantially limited due to the rigidity of the weft thread 6 made of synthetic resin monofilament which is greater than the rigidity of any of the warp threads constituting a woven structure of the outerlining fabric 1.

According to the present invention, the two, transversely spaced fastener portions 3, 3 of the outerlining fabric 1 may be continuous and extending throughout the length of the outerlining fabric 1, as shown in FIG. 1. Alternatively, rows of discrete fastener portions 3 may be formed at predetermined intervals along the length of the outerlining fabric, with element-free spaces 3*a*, 3*b* disposed between two adjacent discrete fastener portions 3, as shown in FIGS. 4 and 5. In the latter case, the element-free spaces 3*a* in the first row of fastener portions 3 and the element-free spaces 3*b* in the second row of fastener portions 3 may have different lengths. In addition, when used with a curtain attachment connector 40 having a number of curtain attachment connector members 42 interconnected by a cord 41 in equally spaced apart relation, if the distance L-1 between two element-free spaces 3*a* (or 3*b* ) is set larger than the distance L-2 between each pair of adjacent curtain attachment connector members 42, a series of horizontally arranged pleats can be automatically formed on the curtain 10 when the curtain 10 is attached to the curtain rail 20.

In the embodiments described above, the fastener portions 3 are composed of female or looped fastener members. The looped fastener members may be replaced by male or hooked fastener member made of monofilament. In the latter case, the fastener surfaces 43 of the respective curtain attachment connector members 42 are composed of female or looped fastener members. With the curtain attachment structure described above, when the curtain 10 is to be detached from the curtain rail 20, detachment can readily be effected merely by progressively peeling the fastener portions 3 apart from the curtain attachment connector members 42 from the left or the right end of the curtain 10.

Furthermore, in the case of the illustrated embodiment, the width of the curtain 10 when closed is automatically determined by stretching the curtain attachment connector 40 along the curtain rail 20, so that the actual width of the curtain 10 can be determined with a high degree of freedom. Although the curtain attachment connector 40 and the curtain runners 30 used in the foregoing embodiment are formed separately from one another, it is possible to integrate the body 31 of each curtain runner 30 and each curtain attachment connector member 42 omitting beth the swivel hook 33 on the curtain runner 30 and the hook 42 on the curtain attachment connector member 42. In the latter case, it is desirable that the curtain attachment connector member 42 is connected to the curtain runner body 31 by a swivel joint and hence is made rotatable about a vertically extending central axis of the curtain runner body 31 in the same manner as a swivel joint 33*a* on the swivel hook 33 shown in FIG. 6. In case where the curtain runner 30 has a circular flange (not shown) formed on an upper end of the body 31 in place of the rollers 32, the curtain runner 30 is rotatable in the curtain rail 20 about a vertically axis. Accordingly, the curtain runner and the curtain attachment connector member may be formed integrally as a single unit which is rotatable about the vertical axis without using-the swivel joint.

Figure 11B:
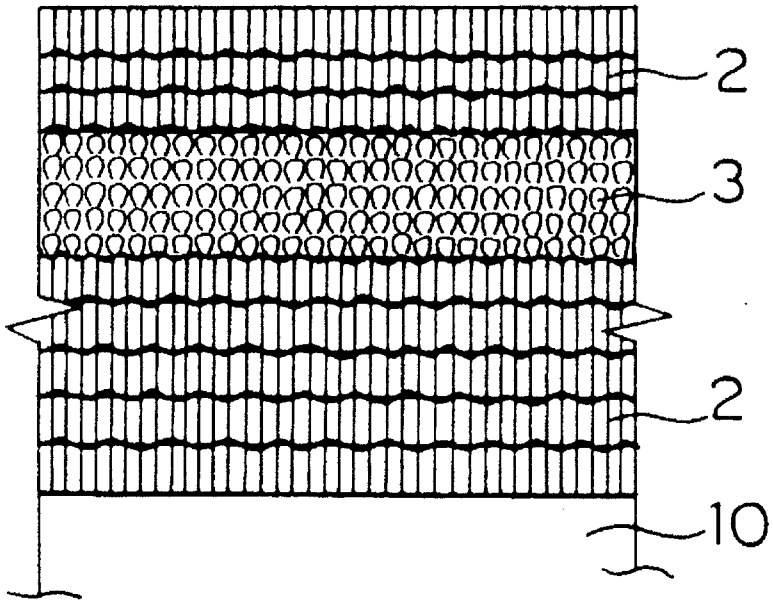
FIGS. 11A and 11B are diagrammatical plan views showing an outerlining fabric according to another preferable embodiment of the present invention.
Figure 11A:
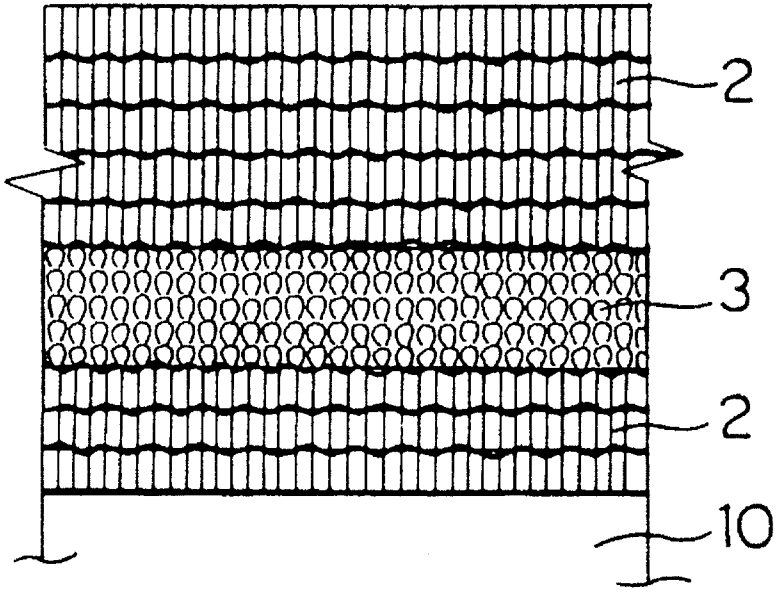

FIGS. 11A and 11B show an outerlining fabric 1 according to another preferred embodiment of the present invention. The outerlining fabric 1 has only one fastener portion 3 (indicated by hatching) extending continuously throughout the length of the outerlining fabric 1. The fastener portion 3 is displaced from a longitudinal center line of the outerlining fabric 1 toward one longitudinal edge of the outerlining fabric 1. The outerlining fabric 1 also has a pair of mesh portions 2, 2 disposed on opposite sides of the fastener portion 3 along the length thereof. The respective woven structures of the mesh portions 2 and the fastener portion 3, and the materials of the warp and weft threads of the outerlining fabric 1 are the same as those used in the outerlining fabric 1 shown in FIG. 1.

In attaching the outerlining fabric 1 to the curtain 10, if the curtain rail 20 (see FIG. 6) is to be concealed by the top edge of the curtain 10, the outerlining fabric 1 is attached to the curtain 10 in such a manner as shown in FIG. 11A in which the fastener portion 3 is spaced far away from the top edge of the curtain 10. Alternatively, when the curtain rail 20 is to be exposed from the top edge of the curtain 10, the outerlining fabric 1 is attached to the curtain 10 in such a manner as shown in FIG. 11B in which the fastener portion 3 is located close to the top edge of the curtain 10. It will be appreciated that the outerlining fabric 1 can readily be attached to a desired position on the curtain 10 only by placing one longitudinal edge of the outerlining fabric 1 in alignment with the top edge of the curtain 10. One of two alternative vertical positions of the fastener portion 3 is automatically determined by turning the outerlining fabric 1 upside down. The number of the fastener portion 3 used in the embodiment shown in FIGS. 11A and 11B is one, but two or more fastener portions can be used provided that they are formed on either the upper or the lower half of the outerlining fabric 1.

FIG. 12 shows further preferred embodiment of the outerlining fabric 1 according to the present invention.

As shown in FIG. 12, half of an outerlining fabric 1 of the present invention from substantially central portion in widthwise to one edge of the outerlining fabric 1 is composed of a female fastener portion 3 having a pile weaving structure, and the other half of the outerlining fabric 1 is composed of a net-like mesh portion 2. The weaving structure of the mesh portion 2 is the same as those of the other embodiments'. In this illustrated example, three ridges 3*c* extending in parallel in the longitudinal direction and two non-ridged portions 2*b* extending between these ridges 3*c* are formed in the fastener portion 3. A plurality of female engaging members are provided in the ridge 3*c*, and the non-ridged portion 2*b* may be composed of a weaving structure which is the same as the foregoing mesh portion 2, however, the non-ridged portion 2*b* also may be composed only of weft threads excluding warp threads from the mesh portion 2.

In the outerlining fabric 1 of the above-described arrangement, an embodiment in FIG. 13 in which the outerlining fabric 1 is applied to a double curtain rails will now be described. A curtain red having a beautiful surface is used as an upper curtain rail 20*a*, and a curtain rail of C-cross section having a structure substantially the same as the curtain rail 20 of FIG. 6 is used as a lower curtain rail 20*b*. A ring-shaped curtain runner 30*a* is rotatably mounted on the upper curtain rail 20*a*. A hook 42*a* of a hook member 42 having a structure shown in FIG. 10 is hooked on a hook hole 30*a* projecting downwardly from the curtain runner 30*a*. A pair of rollers 32 of a curtain runner 30 is inserted through an opening 21*b* into the curtain rail 20*b*. And a hook 42*a* of a hook member 42 having the above described structure is hooked on a hook 33 which projects downwardly from a lower end of the curtain runner 30. On the other hand, the above described outerlining fabric 1 shown in FIG. 12 is sewn onto each of curtains 10*a*, 10*b* along upper edges thereof, which are attached to the upper and lower curtain rails 20*a*, 20*b* respectively. However, the outerlining fabric 1 which is to be attached onto the curtain 10*a* to be attached to the upper curtain rail 20*a* is sewn onto the curtain 10*a* in such a manner that the fastener portion 3 is disposed in an upper part of the outerlining fabric 1, and the outerlining fabric 1 which is to be attached onto the curtain 10*b* to be attached to the lower curtain rail 20*a* is sewn onto the curtain 10*b* in such a manner that the fastener portion 3 is disposed in an lower part of the outerlining fabric 1.

Figure 13:
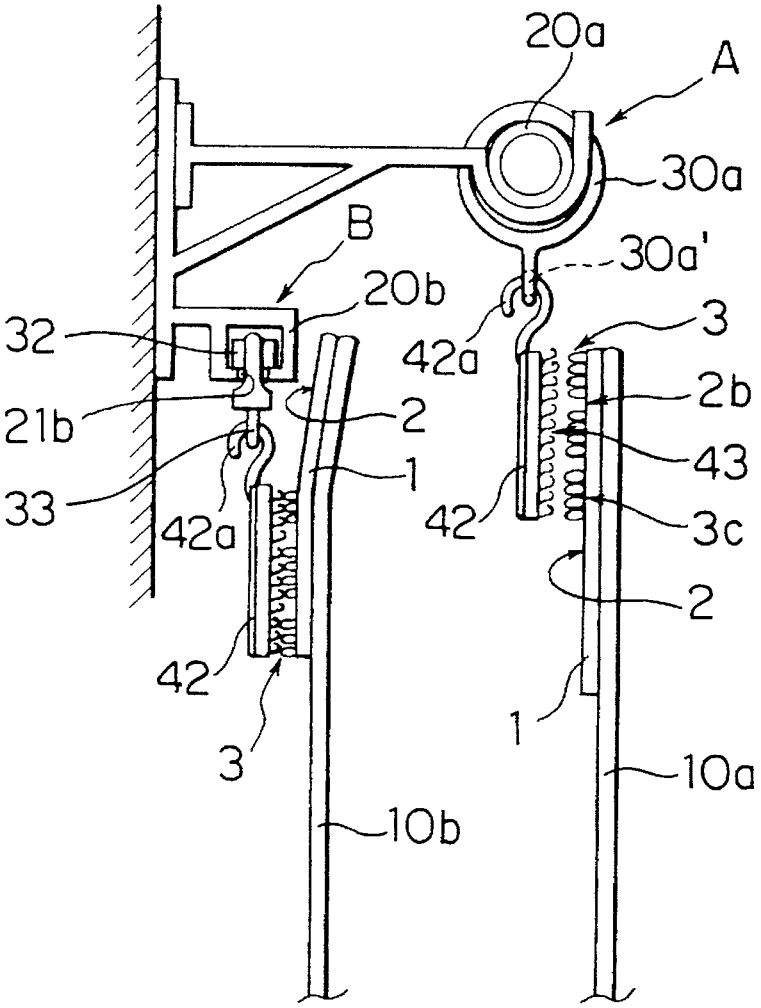

As the respective fastener portions 3, 3 of the curtains 10*a*, 10*b* onto which the outerlining fabrics 1, 1 are attached engage with fastener surface 43 of each of the hook members 42, the upper curtain rail 20*a* is exposed upward of the curtain 10*a* as indicated by an arrow A in FIG. 13, and the lower curtain rail 20*b* is concealed by the curtain 10*b* as indicated by an arrow B in FIG. 13.

As described above, according to the present invention, various modifications of the form and usage in regard of the outerlining fabric can be adopted. And when a plurality of non-ridged portions 2*b* are provided in parallel in the fastener portion 3 longitudinally, if the outerlining fabric 1 is attached to a lace curtain for example, a rear side can be seen through the non-ridged portion 2*b* composed of the mesh portion, so that the positioning for sewing and the sewing operation itself become easy, and further, the cool touch of the lace curtain textile will not be lost and the fastener portion 3 dries up early when it is washed. The formation of the fastener portion 3 with the non-ridged portion 2*b* shown in FIG. 14 may also applied to outerlining fabric 1 of FIGS. 1, 4, 5, 7 and 11.

As described above, an outerlining fabric for curtains which is provided according to one embodiment of the present invention is formed by weaving and includes at least two fastener portions extending lengthwise of the outerlining fabric and spaced apart widthwise of the outerlining fabric by a mesh portion of a predetermined width. With the outerlining fabric, at least two vertical positions are readily available for a curtain when the curtain is attached to a curtain rail. Attachment and detachment of the curtain relative to the curtain rail can be accomplished, with utmost ease by using a curtain attachment connector which is provided according to the embodiment of the present invention, An outerlining fabric provided according to another embodiment of the invention includes at least one fastener portion formed to be displaced from a longitudinal center line of the outerlining fabric toward one longitudinal edge of the outerlining fabric. This outerlining fabric can be manufactured at a lower cost than the outerlining fabric in the first-mentioned embodiment but can exhibit the same function as that in the first-mentioned embodiment merely by turning the outerlining fabric through an angle of 180 degrees when attaching the outerlining fabric to the curtain.

In the case where rows of discrete fastener portions are formed along the length of the outerlining fabric at first predetermined intervals, and the curtain attachment connector includes a number of curtain attachment connector members interconnected by a cord at second predetermined intervals which are smaller than the first predetermined intervals, a series of pleats are automatically formed on the top edge of the curtain when the curtain is attached to the curtain rail. Thus, the top edge of the curtain, i.e., the attachment portion of the curtain is automatically folded in a naturally corrugated condition and has an adequate flexibility. The curtain can, therefore, be opened and closed smoothly. In addition, the curtain, when bound at its fully opened position, is very sightly in appearance and has a neatly folded posture.

Furthermore, since the woven outerlining fabric has a weft thread composed of a monofilament having a rigidity, the top edge of the curtain is able to hold its upstanding posture without becoming collapsed toward the interior side even when the curtain is attached to the curtain rail in such a manner that the curtain rail is concealed by the top edge of the curtain.

In the present invention, when the above-described wide mesh portion and a plurality of mesh portion which extends longitudinally in parallel in the fastener portion are provided, if the outerlining fabric is used for a lace curtain for example, the rear side of the non-ridged mesh portion can be seen as the mesh portion is transparent so that the positioning for sewing and the sewing operation become easy, and further, the cool touch of the lace curtain textile will not be lost. And the fastener portion can be dried up faster when it is washed.

Obviously, various minor changes and modifications of the present invention are possible in the light of the above teaching. It is therefore to be understood that within the scope of the appended claims the invention may be practiced otherwise than as specifically described.

What is claimed is:

1. An elongated outerlining fabric adapted to be attached to a curtain along a top edge thereof, comprising:

(a) at least two fastener portions having a woven structure and extending lengthwise of said elongated outerlining fabric, each of said fastener portions being composed of one of a pair of male and female surface-type separable fastener members; and (b) a mesh portion having a net-like woven structure of a predetermined width and disposed between said fastener portions to separate them in the widthwise direction of said outerlining fabric, (c) said fastener portions and said mesh portion being woven of a plurality of types of warp threads running lengthwise of said outerlining fabric and a weft thread running widthwise of said outerlining fabric, said weft thread being composed of a synthetic resin monofilament having a rigidity.

2. An elongated outerlining fabric according to claim 1, wherein each of said fastener portions is continuous and extends throughout the length of said outerlining fabric.

3. An elongated outerlining fabric according to claim 1, wherein each of said fastener portions is composed of a row of discrete fastener portions arranged lengthwise of said outerlining fabric with element-free spaces disposed between adjacent ones of said discrete fastener portions.

4. An elongated outerlining fabric according to claim 1, wherein said fastener portion is formed by a plurality of longitudinal ridges and at least a narrow linear non-ridged portion which is composed of net-like mesh portion and is provided longitudinally between said ridges.

5. An elongated outerlining fabric according to claim 3, wherein one row of said discrete fastener portions has a pitch which is different from that of another row of said discrete fastener portions.

6. An elongated outerlining fabric adapted to be attached to a curtain along a top edge thereof, comprising:

(a) at least one fastener portion having a woven structure of a predetermined width and extending lengthwise of said elongated outerlining fabric, said fastener portion being composed of one of a pair of male and female surface-type separable fastener members and disposed to be displaced from a longitudinal center line of said outerlining fabric toward one longitudinal edge of said outerlining fabric; and (b) at least two mesh portions having a net-like woven structure and disposed on opposite sides of said fastener portion, (c) said fastener portion and said mesh portions being woven of a plurality of types of warp threads running lengthwise of said outerlining fabric and a weft thread running widthwise of said outerlining fabric, said weft thread being composed of a synthetic resin monofilament having a rigidity.

7. An elongated outerlining fabric according to claim 6, wherein said fastener portion is continuous and extends throughout the length of said outerlining fabric.

8. An elongated outerlining fabric according to claim 6, wherein said fastener portion is composed of a row of discrete fastener portions arranged lengthwise of said outerlining fabric with element-free spaces disposed between adjacent ones of said discrete fastener portions.

9. An elongated outerlining fabric according to claim 6, wherein said fastener portion is formed by a plurality of longitudinal ridges and at least a narrow linear non-ridged portion which is composed of net-like mesh portion and is provided longitudinally between said ridges.

10. An elongated outerlining fabric according to claim 8, wherein one row of said discrete fastener portions has a pitch which is different from that of another row of said discrete fastener portions.

11. An elongated outerlining fabric adapted to be attached to a curtain along a top edge thereof, comprising:

(a) a fastener portion having a woven structure and extending lengthwise of said elongated outerlining fabric, said fastener portion being composed of one of a pair of male and female surface-type separable fastener members and disposed in one of two halves of the outerlining fabric substantially from a longitudinal center line to one longitudinal edge of the outerlining fabric;

(b) a mesh portion being disposed in the other half of the outerlining fabric; and (c) said fastener portion and said mesh portion sewing woven of a plurality of types of warp threads running lengthwise of said outerlining fabric and a weft thread running widthwise of said outerlining fabric, said weft thread being composed of a synthetic resin monofilament having a rigidity.

12. An elongated outerlining fabric according to claim 11, wherein each of said fastener portions is continuous and extends throughout the length of said outerlining fabric.

13. An elongated outerlining fabric according to claim 11, wherein each of said fastener portions is composed of a row of discrete fastener portions arranged lengthwise of said outerlining fabric with element-free spaces disposed between adjacent ones of said discrete fastener portions.

14. An elongated outerlining fabric according to claim 11, wherein said fastener portion is formed by a plurality of longitudinal ridges and at least a narrow linear non-ridged portion which is composed of net-like mesh portion and is provided longitudinally between said ridges.

15. An elongated outerlining fabric according to claim 13, wherein one row of said discrete fastener portions has a pitch which is different from that of another row of said discrete fastener portions.

16. A curtain attachment structure comprising:

(a) a curtain including an elongated outerlining fabric attached to and along a top edge of said curtain, said outerlining fabric including at least two fastener portions having a woven structure and extending lengthwise of said elongated outerlining fabric, each of said fastener portions being composed of one of a pair of male and female surface-type separable fastener members, said outerlining fabric further including a mesh portion having a net-like woven structure of a predetermined width and disposed between said fastener portions to separate them in the widthwise direction of said outerlining fabric, said fastener portions and said mesh portion being woven of a plurality of types of warp threads running lengthwise of said outerlining fabric and a weft thread running widthwise of said outerlining fabric, said weft thread being composed of a synthetic resin monofilament having a rigidity;

( b ) a curtain rail; and (c) an attachment connector slidably movable along said curtain rail and engageable with said outerlining fabric to attach said curtain to said curtain rail, said curtain attachment connector including a plurality of connector members each having a fastener surface releasably engageable with each of said fastener portions of said outerlining fabric.

17. A curtain attachment structure according to claim 16, wherein each of said fastener portions is continuous and extends throughout the length of said outerlining fabric.

18. A curtain attachment structure according to claim 16, wherein each of said fastener portions is composed of a row of discrete fastener portions arranged lengthwise of said outerlining fabric with element-free spaces disposed between adjacent ones of said discrete fastener portions, and wherein each of said connector members is engageable with a corresponding one of said discrete fastener portions.

19. A curtain attachment structure according to claim 16, wherein said fastener portion is formed by a plurality of longitudinal ridges and at least a narrow linear non-ridged portions which is composed of net-like mesh portion and is provided longitudinally between said ridges.

20. A curtain attachment structure according to claim 18, wherein said row of discrete fastener portions have a first pitch, and said curtain attachment connector further includes a cord interconnecting said connector members in equally spaced relation at a second pitch which is smaller than said first pitch of said row of discrete fastener portions.

21. A curtain attachment structure according to claim 20, wherein one row of said discrete fastener portions has a pitch which is different from that of another row of said discrete fastener portions.

22. A curtain attachment structure comprising:

(a) a curtain including an elongated outerlining fabric attached to and along a top edge of said curtain, said outerlining fabric including at least one fastener portion having a woven structure of a predetermined width and extending lengthwise of said elongated outerlining fabric, said fastener portion being composed of one of a pair of male and female surface-type separable fastener members and disposed to be displaced from a longitudinal center line of said outerlining fabric toward one longitudinal edge of said outerlining fabric, said outerlining fabric further including at least two mesh portions having a net-like woven structure and disposed on opposite sides of said fastener portion, said fastener portion and said mesh portions being woven of a plurality of types of warp threads running lengthwise of said outerlining fabric and a weft thread running widthwise of said outerlining fabric, said weft thread being composed of a synthetic resin monofilament having a rigidity;

(b) a curtain rail; and (c) an attachment connector slidably movable along said curtain rail and engageable with said outerlining fabric to attach said curtain to said curtain rail, said curtain attachment connector including a plurality of connector members each having a fastener surface releasably engageable with said fastener portion of said outerlining fabric.

23. A curtain attachment structure according to claim 22, wherein said fastener portion is continuous and extends throughout the length of said outerlining fabric.

24. A curtain attachment structure according to claim 22, wherein said fastener portion is composed of a row of discrete fastener portions arranged lengthwise of said outerlining fabric with element-free spaces disposed between adjacent ones of said discrete fastener portions, each of said connector members being engageable with a corresponding one of said discrete fastener portions.

25. A curtain attachment structure according to claim 22, wherein said fastener portion is formed by a plurality of longitudinal ridges and at least a narrow linear non-ridged portions which is composed of net-like mesh portion and is provided longitudinally between said ridges.

26. A curtain attachment structure according to claim 24, wherein one row of said discrete fastener portions have a first pitch, and said curtain attachment connector further including a cord interconnecting said connector members in equally spaced relation at a second pitch which is smaller than said first pitch of said row of discrete fastener portions.

27. A curtain attachment structure according to claim 26, wherein one row of said discrete fastener portions has a pitch which is different from that of another row of said discrete fastener portions.

* * * * *